United States Patent [19]

Pearson et al.

[11] 4,353,192

[45] Oct. 12, 1982

[54] FIRE-RESISTANT METAL STUD

[75] Inventors: Robert J. Pearson, Tonawanda; Rodney G. Buergin, Snyder, both of N.Y.

[73] Assignee: National Gypsum Company, Buffalo, N.Y.

[21] Appl. No.: 730,994

[22] Filed: Oct. 8, 1976

[51] Int. Cl.[3] ..... E04B 1/00

[52] U.S. Cl. ..... 52/281; 52/481; 52/729

[58] Field of Search ..... 52/481, 729, 281, 495, 52/282

[56] References Cited

U.S. PATENT DOCUMENTS

| | | | |
|---|---|---|---|
| 3,066,772 | 12/1962 | Gibson et al. | 52/729 X |
| 3,308,586 | 3/1967 | Olson | 52/495 |
| 3,483,665 | 12/1969 | Miller | 52/282 X |
| 3,609,933 | 10/1971 | Jahn et al. | 52/481 X |
| 3,940,899 | 3/1976 | Balinski | 52/481 |
| 3,974,608 | 8/1976 | Grearson | 52/282 X |
| 4,047,355 | 9/1977 | Knorr | 52/303 X |

*Primary Examiner*—Price C. Faw, Jr.
*Assistant Examiner*—Carl D. Friedman

[57] ABSTRACT

A formed sheet metal stud having a flange on the opposite side of the wall from that which is exposed to a fire, which flange is formed by a double thickness of the sheet metal which is loosely folded, leaving a finite space between the two thicknesses to function as a chimney, providing a cooling effect on portions of the stud adjacent the highest temperatures of the fire. Small holes are formed in the outer face of the loosely folded flange to permit cooler air from the unexposed side of the stud to enter the void within the loosely folded flange, where the air rises and cools the stud, and/or they permit heated air rising within the void to escape.

6 Claims, 2 Drawing Figures

FIRE-RESISTANT METAL STUD

This invention relates to sheet metal studs for supporting gypsum wallboard, particularly for improved fire resistance in a hollow shaft wall.

Several forms of sheet metal studs have been developed recently for use with gypsum wallboard to construct a relatively fire-resistant hollow shaft wall, for such as elevator shafts, which walls can be constructed from one side. Examples of these hollow shaft wall studs are disclosed in U.S. Pats. Nos. 3,740,912, 3,839,839 and 3,940,899. Each of these shaft wall studs has one side to which wallboard is attached externally and a double flange second side designed to have wallboard held against the inner side of each of the two flanges.

The fire resistance of walls is dependent upon the rate at which the temperature rises on all portions of the surface on the unexposed side, as the exposed side is subjected to a fire, and the consequent continually rising temperatures on the side exposed to the fire. This fire resistance of a wall which is not of similar structure on both faces is measured in two separate tests, in one of which one of the two sides is exposed to the fire, and in another test the other side is the exposed side. In a test of the hollow shaft walls with the fire on the side of the externally attached wallboard, a problem exists in that on the unexposed side, at the studs, which are a portion of the unexposed surface, the temperature rises very fast.

Accordingly, in tests to determine the resistance of prior shaft walls to a fire on the externally attached wallboard side, the fast temperature rise measurements obtained on the stud surface on the double flange internally attached wallboard side is of an undesirable degree.

The stud of the present invention provides a marked improvement in fire resistance, particularly in fires occurring on the externally attached wallboard side of the wall. In accordance with the invention, the flanges on the double flange internally attached wallboard side include a flange which is of a double thickness with a finite gap between the two layers of sheet metal. Also, the outer of the two layers in this double thickness flange has a plurality of holes for passage of air therethrough.

It is an object of the invention to provide a sheet metal stud with novel means for cooling at least one surface of the stud in a fire.

It is a further object to provide a shaft wall structure having improved fire resistance in the formed sheet metal stud.

These and other objects and advantages will be clearly understood in considering the preferred embodiments as set forth in the specification and shown in the drawings in which.

Figure 1:
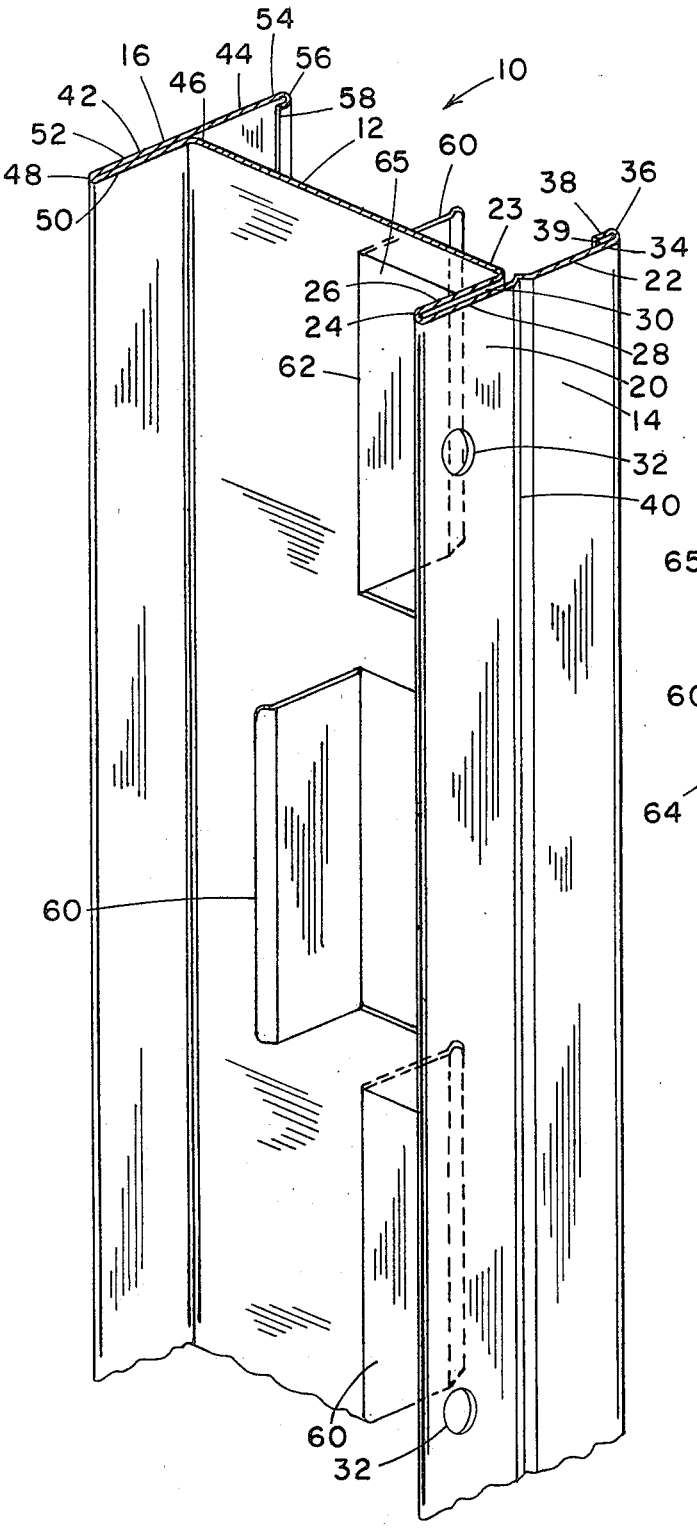
FIG. 1 is an isometric view of a section of the stud embodying the present invention.

Referring to FIG. 1, there is shown an elongate, lightweight metal stud 10, formed from sheet metal, preferably 24 gauge galvanized steel, and formed as a one-piece unit, including a central web 12 which extends from a first side 14 of stud 10 to a second side 16.

First side 14 has a double thickness flange 20 and a single thickness flange 22. Double thickness flange 20 is formed from sheet metal which extends perpendicularly from the edge 23 of web 12 outwardly to a reverse fold 24 forming inner layer 26 of flange 20. The sheet metal extends from reverse fold 24 back to adjacent the edge 23 of web 12, forming outer layer 28 of flange 20. Outer layer 28 is disposed parallel to inner layer 26 with a gap 30 therebetween of about 0.025 inch (0.06 cm) or within a range of about 1/16 to 1/64 inch (0.04 to 0.16 cm).

Outer layer 28 has a plurality of holes 32 centered laterally therealong at spaced positions of about 1 foot (30 cm) apart, and of a diameter of about $\frac{3}{8}$ inch (1 cm) in a flange 20 width of about $\frac{3}{4}$ inch (2 cm).

Single thickness flange 22 extends from outer layer 28 in the opposite direction from web edge 23, and has a width of about $\frac{3}{4}$ inch (2 cm). At the remote edge 34 of single thickness flange 22 there is a reverse fold 36 and a short lip 38 extending back toward web edge 23. In the preferred form, a gap 39, equal to gap 30, is provided between lip 38 and flange 22.

A stiffening rib 40 is formed in first side 14 at the junction of the single thickness flange 22 and the double thickness flange 20, consisting of a shallow rib extending inwardly about 0.1 inch (0.25 cm) toward the web 12. Rib 40 is not essential, and if formed therein care should be taken not to block air from moving freely from gap 30 toward gap 39.

Second side 16 has a double thickness flange 42 and a single thickness flange 44. Double thickness flange 42 is formed from sheet metal which extends perpendicularly from the edge 46 of web 12 outwardly to a reverse fold 48 forming inner layer 50 of flange 42. The sheet metal extends from reverse fold 48 back to adjacent the edge 46 of web 12, forming outer layer 52 of flange 42. Outer layer 52 is disposed parallel to and tight against inner layer 50.

Single thickness flange 44 extends from outer layer 52 in the opposite direction from web edge 46. Flanges 42 and 44 are each about $\frac{3}{4}$ inch (2 cm) wide. At the remote edge 54 of single thickness flange 44 there is a reverse fold 56 and a short lip 58 extending back toward web edge 46.

Web 12 has a plurality of small tabs 60 which are cut and folded out of the metal sheet from which web 12 is made. Tabs 60 are folded along fold 62 which extend parallel to flanges 42 and 44. Some of the tabs 60 are bent about 90 degrees out of the plane of web 12 in one direction and some are bent about 90 degrees out of the plane of web 12 in the opposite direction, with preferably every other tab 60 being in the same direction. Thus every other tab 60 is disposed in spaced parallel relation to flange 20, suitable for holding the edge of a 1 inch (2.5 cm) gypsum board 64 between the tabs 60 and flange 20. The alternate tabs 60 are disposed in spaced parallel relation to flange 22, suitable for holding the edge of another board 64. The forming of the tabs 60 results in forming holes 65 in web 12 which are located between the folds 62 and the stud first side 14.

Figure 2:
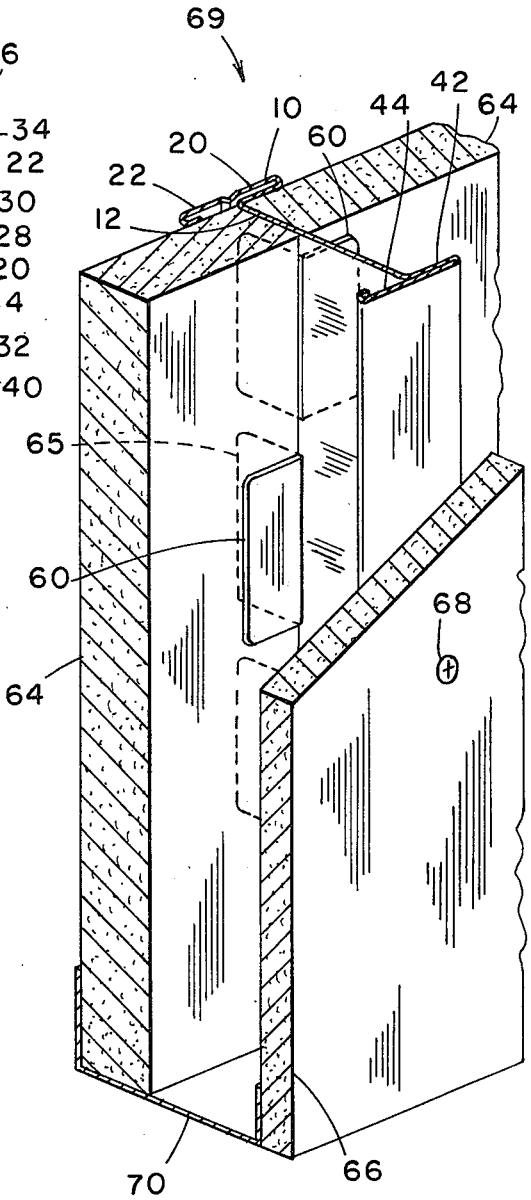
FIG. 2 is an isometric view of a shaft wall embodying the stud of FIG. 1.

FIG. 2 shows the boards 64 being held against the inner side of flanges 20 and 22. Also shown is a gypsum wallboard 66 of about $\frac{5}{8}$ inch ($1\frac{1}{2}$ cm) affixed by screws 68 to the outer face of flanges 42, 44, forming hollow wall 69. One layer of wallboard 66 or multiple layers may be used, dependent on the degree of fire retardancy sought.

The section of wall shown in FIG. 2 also includes a section of floor runner 70.

In a fire, with the fire on the side adjacent the $\frac{5}{8}$ inch wallboard 66, thermocouples will be placed on the opposite side of the wall in places likely to increase in temperature fastest. A thermocouple on the outer surface of the stud 10, at flange 20 or 22, will not indicate an increase in temperature as fast as in prior studs due to the novel combination of the gap 30, gap 39 and the holes 32. As the stud starts to increase in temperature, air will rise in gap 30, and relatively cooler air will be drawn into gap 30 through lower holes 32 and/or through other openings and exhausting as superheated air through holes 32 higher up, all cooling the stud very markedly, making the stud, and the resultant wall a markedly improved fire-resistant wall.

Having completed a detailed disclosure of the preferred embodiments of our invention, so that others may practice the same, we contemplate that variations may be made without departing from the essence of the invention.

We claim:

1. A fire-resistant metal stud for supporting a vertical wall comprising an elongate formed sheet metal body having an elongate first side and, opposite thereto, an elongate second side, elongate means central thereof adjoining said first side and said second side, means on said second side for affixing wallboard thereto, a pair of flanges on said first side adapted to have the edges of a pair of wallboards affixed against the inner side thereof, whereby said flanges would be disposed on the surface of a wall formed by said wallboards, said pair of flanges including at least one flange which is formed from an inner layer sheet of metal extending from the inner edge of the flange to the outer edge of the flange whereat the metal is reversely folded and extends back to said inner edge forming an outer layer, said inner layer and said outer layer being closely spaced apart and parallel, whereby air that becomes heated will tend to move vertically upward within a gap between said inner layer and said outer layer.

2. A fire-resistant wall, comprising a plurality of vertically disposed studs as defined in claim 1 and a plurality of wallboards supported by said studs, means for air to enter said gap prior to moving vertically upward therewithin and means for air to exit from said gap after having moved vertically upward therewithin.

3. The stud of claim 1 wherein said gap is of about 1/64 inch to 1/16 inch.

4. The stud of claim 2 wherein said metal stud is formed of steel of about 24 gauge.

5. A fire-resistant wall, comprising a plurality of vertically disposed studs as defined in claim 1, wherein said studs are mounted in fixed parallel relation with boards mounted therebetween forming a hollow wall, one set of said boards having edges affixed against the inner side of the flanges on said first side of said studs, and a second set of boards being affixed to the outer side of the second side of said studs.

6. A fire-resistant wall as defined in claim 5 wherein each said stud has a central web with outwardly bent tabs cut therefrom, said tabs holding said boards affixed against the inner side of the flanges on said first side of said stud, and the outward bending of said tabs leaving holes between the edges of said boards being held by said tabs.

* * * * *

UNITED STATES PATENT AND TRADEMARK OFFICE

CERTIFICATE OF CORRECTION

PATENT NO. : 4,353,192

DATED : October 12, 1982

INVENTOR(S) : ROBERT J. PEARSON and RODNEY G. BUERGIN

It is certified that error appears in the above-identified patent and that said Letters Patent are hereby corrected as shown below:

On the front page, there should have been included---Attorney, Agent or Firm - Robert F. Hause --.

In claim 4, "stud of claim 2" should have read ---stud of claim 3---.

Signed and Sealed this

First Day of February 198

[SEAL]

Attest:

GERALD J. MOSSINGHOFF

Attesting Officer

Commissioner of Patents and Trademarks

REEXAMINATION CERTIFICATE (925th)

United States Patent [19]

[11] B1 4,353,192

Pearson et al.

[45] Certificate Issued Sep. 27, 1988

[54] FIRE-RESISTANT METAL STUD

[75] Inventors: Robert J. Pearson, Tonawanda; Rodney G. Buergin, Snyder, both of N.Y.

[73] Assignee: National Gypsum Company, Buffalo, N.Y.

Reexamination Request:
No. 90/001,370, Nov. 9, 1987

Reexamination Certificate for:

| | |
|---|---|
| Patent No.: | **4,353,192** |
| Issued: | **Oct. 12, 1982** |
| Appl. No.: | **730,994** |
| Filed: | **Oct. 8, 1976** |

Certificate of Correction issued Feb. 1, 1983.

[51] Int. Cl.[4] ..... E04B 1/00

[52] U.S. Cl. ..... 52/281; 52/481; 52/729

[58] Field of Search ..... 52/481, 282

[56] References Cited

U.S. PATENT DOCUMENTS

| | | | |
|---|---|---|---|
| 3,702,044 | 11/1972 | Balinski | 52/30 |
| 3,839,839 | 10/1974 | Tillisch et al. | 52/481 |

OTHER PUBLICATIONS

R. B. Williamson, Report to United States Gypsum Company on Fire Tests of Two-Hour Shaft Wall System Having C.-H Vented Studs (1975).

*Primary Examiner*—Carl D. Friedman

*Attorney, Agent, or Firm*—Laird Miller; Allen H. Gerstein; Terrence W. McMillin

[57] ABSTRACT

A formed sheet metal stud having a flange on the opposite side of the wall from that which is exposed to a fire, which flange is formed by a double thickness of the sheet metal which is loosely folded, leaving a finite space between the two thicknesses to function as a chimney, providing a cooling effect on portions of the stud adjacent the highest temperatures of the fire. Small holes are formed in the outer face of the loosely folded flange to permit cooler air from the unexposed side of the stud to enter the void within the loosely folded flange, where the air rises and cools the stud, and/or they permit heated air rising within the void to escape.

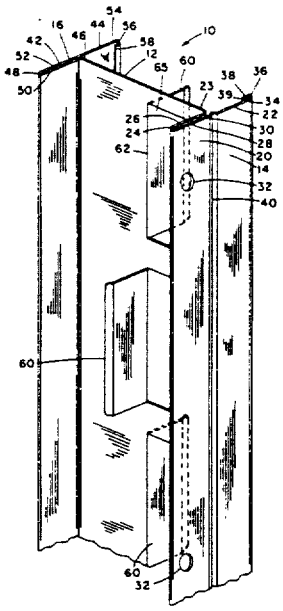

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claims 2–6, dependent on an amended claim, are determined to be patentable.

1. A fire-resistant metal stud for supporting a vertical wall comprising an elongate formed sheet metal body having an elongate first side and, opposite thereto, an elongated second side, elongate means central thereof adjoining said first side and said second side, means on said second side for affixing wallboard thereto, a pair of flanges on said first side adapted to have the edges of a pair of wallboards affixed against the inner side thereof, whereby said flanges would be disposed on the surface of a wall formed by said wallboards, said pair of flanges including at least one flange which is formed from an inner layer sheet of metal extending from the inner edge of the flange to the outer edge of the flange whereat the metal is reversely folded and extends back to said inner edge forming an outer layer, said inner layer and said outer layer being closely spaced apart and parallel *so as to form a gap therebetween, said gap comprising means for air entry and exit along its vertical length when said stud is used in combination with said wallboards*, whereby air *within said gap* that becomes heated will tend to move vertically upward [within a gap between said inner layer and said outer layer] *thereby cooling said stud.*

* * * * *